United States Patent [19]

Haber

[11] 3,975,899

[45] Aug. 24, 1976

[54] MULTI-FUNCTION WATCH CASING

[76] Inventor: Terry M. Haber, 3050 S. Bristol, Apt. 8C, Santa Ana, Calif. 92707

[22] Filed: May 5, 1975

[21] Appl. No.: 574,518

[52] U.S. Cl. ..... 58/88 R; 58/23 R

[51] Int. Cl.[2] ..... G04B 37/00

[58] Field of Search ..... 58/23 R, 23 BA, 50 R, 58/50 A, 53, 55, 88 R, 88 C

[56] References Cited

UNITED STATES PATENTS

| | | | |
|---|---|---|---|
| 2,974,474 | 3/1961 | Wegner | 58/23 BA |
| 2,978,862 | 4/1961 | Epperlein | 58/23 BA |
| 3,597,913 | 8/1971 | Fujimori | 58/23 BA |
| 3,729,923 | 5/1973 | Brigliano | 58/23 BA |
| 3,742,699 | 7/1973 | Bergey | 58/50 R |
| 3,759,031 | 9/1973 | McCullough | 58/50 R |
| 3,838,568 | 10/1974 | Zurcher | 58/88 C |
| 3,858,389 | 1/1975 | Isuruishi | 58/23 BA |

*Primary Examiner*—Joseph F. Peters
*Assistant Examiner*—Vit W. Miska
*Attorney, Agent, or Firm*—Ralph B. Pastoriza

[57] ABSTRACT

A major portion of the watch case is comprised of a molded transparent integral plastic body of electrical insulating material, the top central portion of the body defining a lens for a digital read-out module within the watch and opposite side portions defining coupling ears for the wristwatch band. A metal base assembly is threadedly received in the bottom of the plastic body. The plastic body serves multiple functions including a suppot environment for the module and watchband, a lens for the read-out and an electrically insulating medium for the component terminals within the watch.

6 Claims, 9 Drawing Figures

MULTI-FUNCTION WATCH CASING

This invention relates generally to wristwatches and more particularly to an improved wristwatch casing particularly designed for wristwatches of the digital read-out type.

BACKGROUND OF THE INVENTION

Digital read-out watches of the type with which the present invention is concerned are shown and described in my copending U.S. patent applications, Ser. No. 516,688 filed Oct. 21, 1974 entitled ACTUATING MECHANISM FOR WRIST INSTRUMENTS; Ser. No. 538,743 filed Jan. 6, 1975 entitled ACCELERATION/DECELERATION ACTUATING MECHANISM FOR WRIST INSTRUMENTS; and Ser. No. 556,335 filed Mar. 7, 1975 entitled WRIST ACTUATED PRESSURE SWITCH. Essentially, a quartz crystal is used as an oscillator and the output frequency which is extremely stable is divided down into suitable clock pulses for actuating a digital display visible through a lens on the face of the watch. This display can be provided by light emitting diodes or liquid crystal displays and ordinarily requires some type of display illuminating means which may be actuated by a manually operable push-button on the side of the watch casing or by an inertia-responsive switch, such as shown in all of the foregoing pending patent applications.

The prior art quartz-type digital read-out watches all have a casing made of metal, provided with a top opening for accommodating a transparent lens for viewing the digital read-out. Further frame structures within the metal casing position the watch module which normally incorporates an integrated circuit chip and other components associated with the operation of the watch. In addition, there is provided a base plate or cap which threads into the main metal casing the same being removable for replacing batteries.

Major problems associated with the foregoing types of casings include the relatively high expense in the manufacture of the same. This expense is primarily a result of the use of metal and the necessary machining operations thereon. Further, insulation portions must be provided to prevent the metal casing from short-circuiting the terminals of various components within the casing. In this respect, since the metal casing is electrically conductive, it is vulnerable to static charge build-up and possible damage to the interior components. Further problems include the fact that metal is heavy thus increasing the overall weight of the watch. Also the metal casing construction at the portion it connects to the watchband normally requires special tools to install and remove the band.

Finally, when the batteries are received in the unthreadable base member the overall thickness of the watch is increased over that which would occur if the batteries could be disposed in another location. However, attempting to dispose the batteries in another location requires more metal for the casing and added insulation requirements.

BRIEF DESCRIPTION OF THE PRESENT INVENTION

With the foregoing considerations in mind, the present invention contemplates a novel approach to the provision of a watch casing.

More particularly, rather than utilize metal as the main casing body, the present invention utilizes a molded transparent integral plastic body of electrical insulating material shaped to surround and position the upper portion of the watch module and having a top central portion defining a lens for the digital read-out on top of the module. Integrally molded plastic side portions define coupling ears for a wristwatch band which can be readily inserted without need of special tools. A surrounding wall portion of the plastic body includes at least one and preferably several molded openings for accommodating portions of the normal time setting switch and further switches such as those provided for illuminating the digital display.

Since the entire plastic body is formed by a single molding operation, such as injection molding, it is easy and inexpensive to produce the plastic body with all of the various characteristics and features which enable it to serve several functions simultaneously. As a consequence, many components normally required such as insulation portions and the like can be eliminated and the overall weight of the watch casing is substantially reduced.

BRIEF DESCRIPTION OF THE DRAWINGS

A better understanding of this invention as well as further features and advantages thereof will be had by now referring to the accompanying drawings in which.

DETAILED DESCRIPTION OF THE INVENTION

Figure 1:
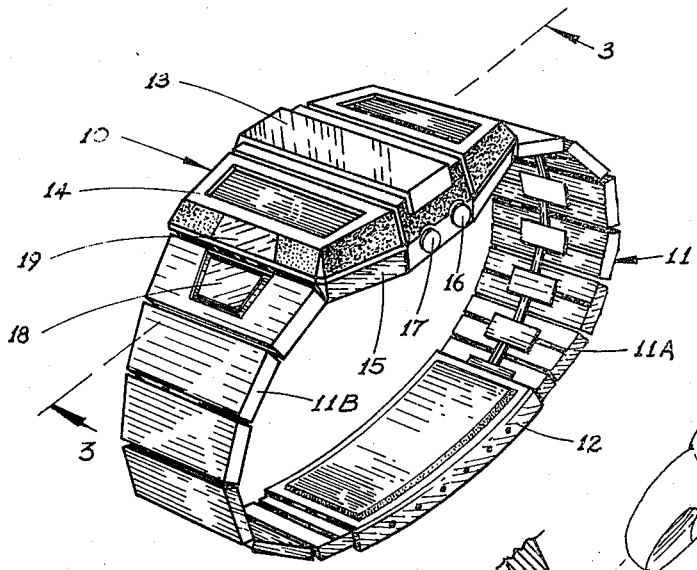
FIG. 1 is a perspective view of a wristwatch and band incorporating the present invention.

Referring first to FIG. 1 there is shown a watch 10 provided with a watchband 11 comprised of band portions 11A and 11B extending from opposite sides of the watch casing and coupled together as by a clasp 12. A lens for the watch is indicated at 13 and, as will become clearer as the description proceeds, constitutes an integral portion of a plastic body comprising a major portion of the watch case.

In the preferred embodiment of the invention illustrated in FIG. 1 there is provided a thin metal cover 14 of conducting material overlying the top of the plastic body except for the lens area. The casing assembly itself is completed by a lower base assembly 15. A display illuminating manually operable switch button is shown at 16 and a manually operable time setting switch button is shown at 17.

In the specific embodiment of FIG. 1 incorporating the thin metal cover 14, there is provided a conducting portion 18 constituting part of the watch band half 11B. This conducting portion constitutes a touch plate which cooperates with a smooth area 19 on the metal cover 14, the purpose for which will become clearer as the description proceeds.

Figure 2:
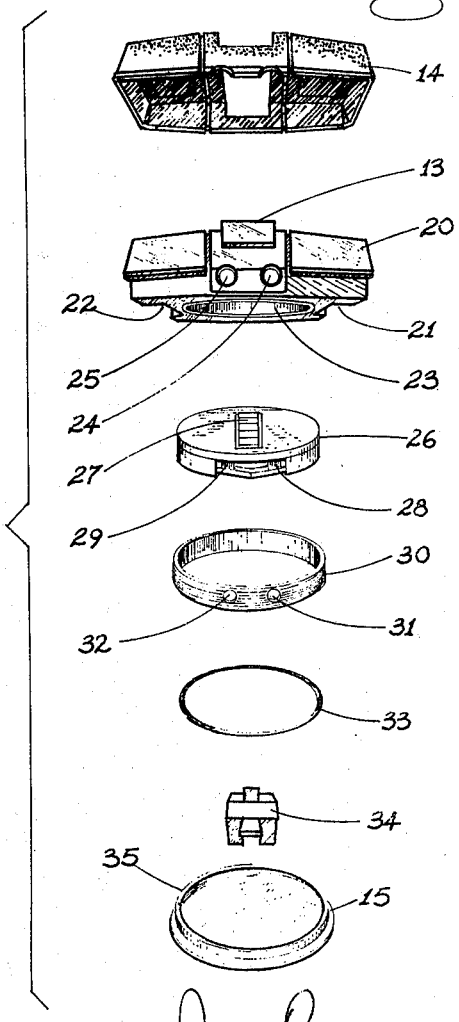
FIG. 2 is an exploded perspective view of the basic casing structure including a showing of the watch module providing a digital read-out which is enclosed within the casing.

Referring now to the exploded view of FIG. 2, there is shown at 20 the plastic body making up the major portion of the watch casing. This body constitutes a molded transparent integral structure of electrical insulating material, the top central portion of which defines the lens 13 as described in conjunction with FIG. 1. Opposite side portions of the plastic body 20 define integral coupling ears for the wristwatch band as indicated at 21 and 22. A surrounding integral wall portion defines a bottom opening means 23 and at least one and in the embodiment disclosed two molded openings 24 and 25 for accommodating portions of the display illuminating switch button 16 and time setting switch button 17 described in FIG. 1.

As is evident from the exploded view, the plastic body 20 is shaped to surround and position the upper portion of a watch module 26 having a digital read-out 27 on its top surface, this read-out being visible through the lens portion 13 of the plastic case when the components are assembled. Internal terminals for electrical connection of suitable battery means to the module 26 are indicated at 28 and 29.

The base assembly 15 as illustrated in the lower portion of FIG. 2 takes the form of a flat disc-shaped conducting member cooperating with an annular conducting ring 30 having external threads and suitable openings 31 and 32 for accommodating the switches 16 and 17 described in FIG. 1. The assembly is completed by the provision of a sealing gasket 33 and a conducting leaf-type spring member 34. Internal threads 35 are provided on an integrally formed shallow wall radially spaced inwardly of the periphery of the flat base of the assembly 15. These internal threads receive the annular external threads on the ring member 30 to form in effect a threaded extension in an axial direction.

In the particular embodiment of the invention of FIG. 1, a battery means is disposed in the base assembly, the battery means having first and second terminals, the first terminal making electrical connection with the base 15 through the spring contact 34 and having its second terminal engaging a suitably positioned terminal on the module 26.

Figure 3:
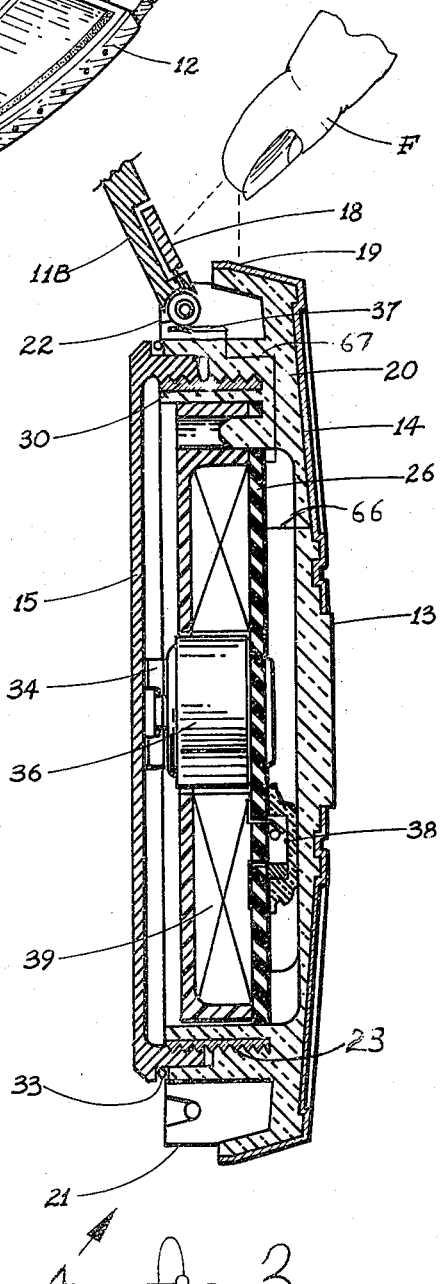
FIG. 3 is a cross section taken in the direction of the arrows 3—3 of FIG. 1 showing the casing in assembled relationship.

Referring to FIG. 3, the foregoing relationship will become clear wherein the annular ring 30 is shown threaded to the base of the assembly 15 and also received in the bottom opening means 23 of the plastic body 20. The battery means is shown in full lines at 36.

Referring to the upper portion of FIG. 3, there is shown a conducting means in the form of a biased spring conductor portion 37 adjacent to the ear couplings 22 for the watchband half-portion 11B. This conducting portion 37 effects an electrical connection to the touch plate 18 described in FIG. 1. Further electrical connections of various components within the watch casing will be described subsequently.

In the particular embodiment of FIG. 3, the plastic casing 20 is further shaped to accommodate an inertia switch designated 38. This inertia switch enables the display to be illuminated without having to manually operate the push-button 16 described in FIG. 1 by simply flicking the wrist. The principles of operation are similar to those described in my heretofore referred-to copending patent application Ser. No. 538,743.

The interior of the module 26 is designated 39 surrounding the battery 36. It will be understood that various components having electrical terminals are provided in the module including an integrated circuit chip, quartz oscillating crystal, time setting over-ride circuit, and appropriate connections to the digital display on top of the module. Applicant's present invention is not concerned specifically with the internal portion of the module or the inertia switch other than the fact that the plastic body 20 can be easily molded to accommodate and properly position these components.

Figure 4:
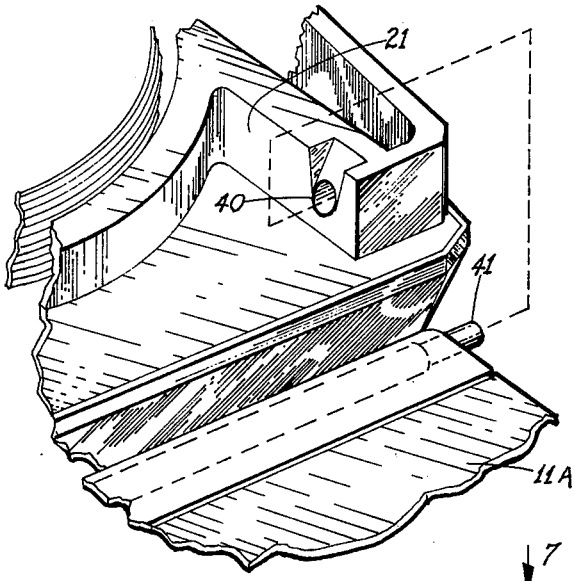
FIG. 4 is an enlarged fragmentary perspective view of a portion of the casing looking in the direction of the arrow 4 of FIG. 3.

Referring to the fragmentary perspective view of FIG. 4, a detail of one of the coupling ears 21 which enables a very simple connection of one of the watchband halves such as the watchband half 11A to be effected without special tools is shown. Thus, there is directly molded in the plastic body an opening 40 recessed in a sloping surface for readily receiving a spring-biased cross pin 41 on the watchband half 11A. It will be evident that in attaching the watchband half, it is only necessary to urge the cross pin downwardly as viewed in FIG. 4 to bias the pin 41 inwardly against the usual internal spring of the pintle, the same than snapping outwardly into the opening 40.

Figure 5:
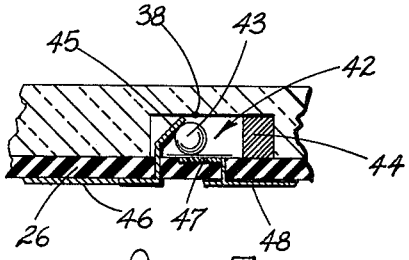
FIG. 5 is an enlarged fragmentary cross section of an inertia switch which may be incorporated in the casing of the watch of FIG. 1.

FIG. 5 shows further details of the inertia switch 38 described in FIG. 3. Essentially, this switch is housed within a cavity 42 and comprises an inertia metal ball 43 and permanent magnet 44 at one end of the cavity. In FIG. 5, the inertia switch is shown in closed position wherein the ball 43 engages a terminal 45 connecting to a suitable printed circuit portion 46 of the module 26 and a further terminal 47 on the floor of the cavity connecting to a further printed circuit portion 48 in the module.

The ball 43 is normally held away from the terminal 45 by the magnet 44. When a user flicks his wrist, the ball 43 is shaken free of the magnet 44 and effects contact between the terminals 45 and 47.

Figure 6:
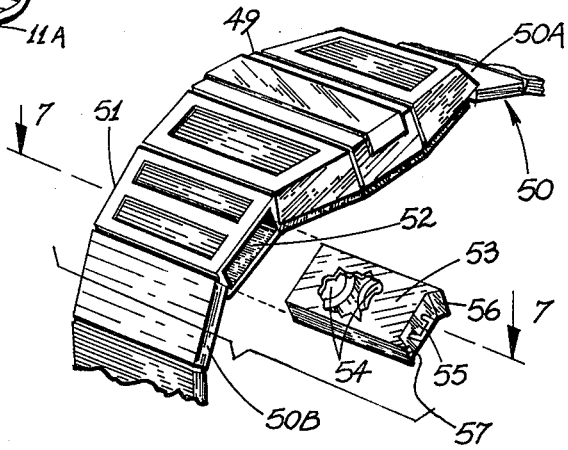
FIG. 6 is a fragmentary perspective view of a modified casing structure capable of accommodating a battery pack, the battery pack itself being shown in exploded view.

Referring now to FIG. 6 there is shown a modified embodiment of the watch casing of this invention enabling the overall casing configuration to be made less thick than required in the embodiment of FIGS. 1, 2 and 3 wherein the battery is incorporated in the base assembly.

Thus, as shown in FIG. 6 there is a watch casing 49 supported on a band 50 made up of band halves 50A and 50B. A side portion of the casing 49 is extended as at 51 where it connects to the band half 50B to define a cavity 52. This cavity is formed in the plastic body portion of the watch casing and is shaped to receive a battery pack 53 incorporating battery means such as batteries 54 therein. The battery pack 53 includes a small loop or hook 55 on a front portion and opposite tapered marginal edges 56 and 57 terminating in knife edges.

Figure 7:
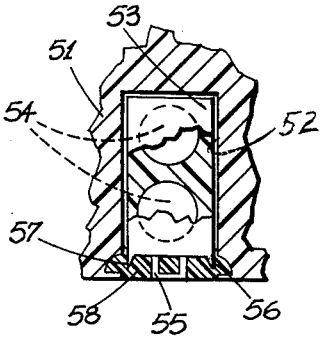
FIG. 7 is a fragmentary cross section taken in the direction of the arrows 7—7 of FIG. 6.

Referring to the fragmentary cross section of FIG. 7, the battery pack 53 is shown positioned within the cavity 52, there being provided a plastic filler 58 closing the front end of the cavity to seal the battery pack in place. It will be noted that the hook 55 extends quite close to the surface of the filler 58. The arrangement is such that in replacing the battery pack, the filler seal can be broken and by pulling on the hook 58, the knife edges 56 and 57 of the battery pack will cut through the remaining portion of the filler seal 58 permitting easy removal.

When a new battery pack is inserted, it is again sealed with new filler 58.

Figure 8:
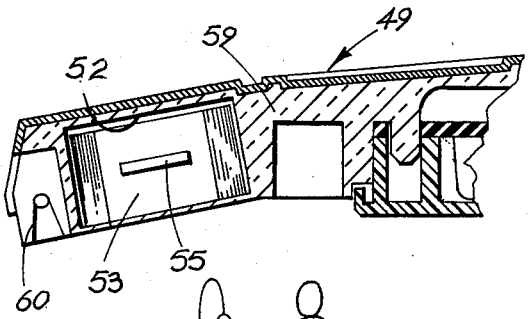
FIG. 8 is another fragmentary cross section of a portion of the casing accommodating the battery pack of FIG. 7; and, FIG. 9 is a simplified schematic diagram of connections between various switches and components incorporated in the module of the watch.

In the fragmentary showing of FIG. 8, the plastic body of the watch casing 49 is shown at 59 and the extended portion defining the cavity 52 will be evident. It will be noted that the coupling ear for the band portion 50B of FIG. 6 is shown at 60 so that it is on the far side of the cavity 52.

As in the case of other portions of the plastic body, the cavity 52 can be directly molded in the body when the plastic body is manufactured.

It will be appreciated that by disposing the batteries to the side of the main portion of the watch casing, it is possible to reduce the overall thickness of the casing.

Specific electrical connections for the battery pack of FIG. 8 to the components within the main portion of the plastic body are not shown in FIG. 8. In this respect, however, it will be understood that one contact of the battery may connect directly to the metal cover for the plastic body while the second battery contact could connect through internal wiring such as provided for the spring contact 37 described in FIG. 3.

Since Applicant's invention has to do with the basic concept of the plastic body casing and cooperating base assembly rather than the internal workings of the watch, details of wire connections in describing the casing structure itself in the various drawings have not been set forth in order to avoid obscuring portions of the drawing. However, the actual electrical connections for the basic components are schematically illustrated in FIG. 9 to which reference is now had.

Figure 9:
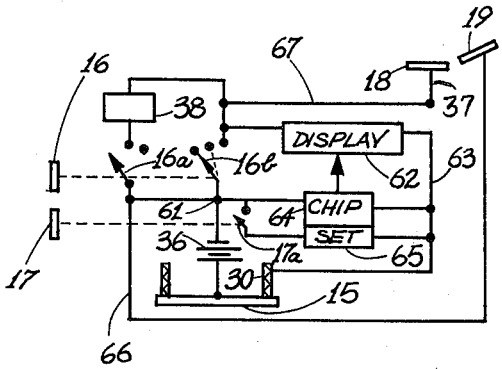

As shown in FIG. 9, the battery means 36 has its first contact or base connected to the base member 15 to which the annular threaded ring 30 electrically connects. The second contact of the battery 36 connects to a junction point 61. The display illuminating switch button 16 operates dual switch arms 16*a* and 16*b* both of which connect to the battery contact junction point 61. The inertia-responsive switch 38 described in FIGS. 3 and 5, is shown as a block 38 in FIG. 9. One of the dual switch arms 16*a* is connected in series with this inertia switch 38 while the other switch arm 16*b* is connected in parallel across the switch 38.

The module described in FIGS. 2 and 3 incorporates a display illuminating means 62 connected in series with the inertia switch 38 and a return lead 63 connecting to the annular threads of the ring 30 and thus to the first contact at the base member 15 of the battery 36. Also included in the module is an integrated chip designated by the block 64 which is continuously energized from the second battery contact junction point 61 and return lead 63 passing to the first battery contact by way of the annular ring 30.

As a part of the chip within the module there is provided an over-ride circuit designated by the block 65 for setting the time. This circuit is energized by the time setting switch button 17 which includes a switch arm 17*a* closing a circuit between the second contact junction point 61 and first battery contact connecting to the base member 15 by way of the annular ring 30.

Finally, there is provided a lead 66 extending from the second battery contact junction 61 to the smoothed portion 19 of the thin metal cover described in FIGS. 1 and 3 of the watch casing. This lead 66 is also illustrated in FIG. 3 by a solid line extending from the thin metal cover into the module to ultimately connect to the second contact of the battery.

The cooperating touch plate 18 is schematically depicted in FIG. 9 adjacent to the conducting portion 19 of the cover and its spring contact 37 described in FIG. 3 is similarly numbered in FIG. 9 and connects to a lead 67 so as to energize the display 62 whenever a person's finger short-circuits the plate and conducting portion 18 and 19 respectively. In this respect, there is schematically indicated a portion of a person's finger F in FIG. 3 preparatory to touching these components to complete a circuit connection. Also, there is designated by the same numeral 67 the connection of the spring conducting contact 37 to the module and subsequently to the display.

Thus, with reference to FIG. 9 it will be appreciated that when the conducting portions 18 and 19 are short-circuited with a person's finger (the natural moisture and oil on the skin completing a circuit), power from the second contact battery junction point 61 will pass through the lead 66, metal cover portion 19, finger, touch plate 18, spring contact 37 and lead 67 into one side of the display 62. The other side of the display as described connects through return lead 63 to the first battery terminal by way of the annular ring 30 and base member 15.

The dual switch arms 16*a* and 16*b* as described in FIG. 9 enable the inertia-responsive switch 38 to be disconnected from the circuit by means of the display illuminating switch button 16 such as might be desired when a person is playing tennis or engaged in another sport wherein it is not desired to have the inertia switch operative. On the other hand, this same manually operable button 16 can be used to manually display the time by pushing it in a sufficient distance to close the switch arm 16*b* against the contact connected to the display 62. When the switch arms are in an intermediate position, the manual illuminating control is disconnected and the inertia responsive switch is connected.

From the foregoing description, it will be evident that the present invention has provided a greatly improved watch case particularly useful for digital type read-out quartz crystal electronic watches wherein by utilizing plastic as a major component of the casing structure, the weight of the watch is substantially decreased and the casing itself can be manufactured for substantially less expense than has been encountered heretofore. Moreover, and in accord with an important feature of this invention, the plastic body as described, serves multiple functions, to wit: a support environment for positioning and supporting the module and watchband, a lens for the digital read-out, and an electrically insulating medium for the component electric terminals in the watch. Also, with respect to the modified embodiment of FIG. 6, the same plastic casing can readily be molded with the integral extending portion defining a cavity to receive a battery pack and thus enable the provision of a lower profile watch.

What is claimed is:

1. A multi-function casing for a digital type read-out band supported wristwatch normally containing a module with digital read-out on its top surface, battery means having first and second contacts, a display illuminating switch, and a manually operable time setting switch with external button, comprising, in combination:

a. a molded transparent integral plastic body of electrical insulating material shaped to surround and position the upper portion of said module, the top central portion of said body defining a lens for said digital read-out, opposite side portions defining coupling ears for a wristwatch band, and one surrounding wall portion having at least one molded opening for accommodating portions of the time setting switch;

b. an annular metal base assembly having annular ring means, said plastic body having a bottom opening means receiving said annular ring means, said base assembly being in electrical communication with said first contact of said battery means, the second contact of the battery means connecting to electrical terminals of said switches and module when positioned within said plastic body, the annular ring means of said base assembly providing a return current path from component terminals within said plastic body to said first contact of said battery means;

c. a thin conductive metal cover overlying the top of said plastic body except for that portion defining said lens, said cover being electrically connected to said second contact of said battery means; and, d. a conducting means extending laterally from said module through the plastic wall to electrically engage a conducting portion of the watch band when secured to said coupling ears on one side of said plastic body, whereby said plastic body serves multiple functions including a support environment for the module and watchband, a lens for the read-out, and an electrically insulating medium for the component terminals in the watch, and whereby a touch switch is provided by a person simultaneously touching said conducting portion of said band and said thin conductive metal cover.

2. A casing according to claim 1, in which said base assembly includes a flat disc-shaped conducting member having an integrally formed annular shallow wall radially spaced inwardly with interior threads, said annular ring means defining external annular threads threaded to the internal threads of said annular wall to form a threaded extension in an axial direction.

3. A casing according to claim 1, in which said plastic body includes cavity portions for accommodating an inertia-operated switch for illuminating the digital display and a further molded opening for accommodating said display illuminating switch, said display illuminating switch being manually operable and having dual switch arms, one of which parallels said inertia switch and the other of which is in series with said inertia switch so that said inertia switch can be disconnected from said battery means by said display illuminating switch.

4. A casing according to claim 1, in which said plastic body further includes a cavity in one side, the associated band coupling ears being disposed on the far side of the cavity, said cavity being shaped to receive a battery pack incorporating said battery means so that the overall thickness of the casing can be reduced as compared to the thickness required to accommodate said battery means in said base assembly.

5. A casing according to claim 2, in which said base assembly further includes a sealing gasket about the outside of its annular wall to be sandwiched between the peripheral margin of said disc and an annular portion of said plastic body adjacent to said bottom opening means, and a spring conducting member for effecting electrical contact between said first terminal of said battery means and said flat disc-shaped member, said battery means being disposed between said flat disc-shaped member and module when assembled in said casing.

6. A multi-function casing for a digital type read-out band supported wristwatch normally containing a module with digital read-out on its top surface, battery means having first and second contacts, a display illuminating switch, and a manually operable time setting switch with external button, comprising, in combination:

a. a molded integral plastic body of electrical insulating material shaped to surround and position the upper portion of said module, the top central portion of said body defining a lens for said digital read out, at least one of the opposite side portions defining a cavity shaped to receive a battery pack incorporating said battery means, the far sides of said opposite side portions defining coupling ears for a wristwatch band, and one surrounding wall portion having at least one molded opening for accommodating portions of the time setting switch, and, b. an annular metal base assembly having annular ring means, said plastic body having a bottom opening means receiving said annular ring means, said base assembly being in electrical communication with said first contact of said battery means, the second contact of the battery means connecting to electrical terminals of said switches and module when positioned within said plastic body, the annular ring means of said base assembly providing a return current path from component terminals within said plastic body to said first contact of said battery means, whereby said plastic body serves multiple functions including a support environment for the module and watchband, a lens for the read-out, an electrically insulating medium for the component terminals in the watch, and a battery pack support on one side so that the overall thickness of the casing can be reduced as compared to the thickness required to accommodate said battery means in said assembly.

* * * * *